United States Patent [19]

Dyson

[11] Patent Number: 4,707,005

[45] Date of Patent: Nov. 17, 1987

[54] LATCHING MECHANISM

[75] Inventor: George W. Dyson, Wolverhampton, England

[73] Assignee: Chubb & Son's Lock and Safe Company Limited, Middlesex, England

[21] Appl. No.: 883,188

[22] Filed: Jul. 8, 1986

[30] Foreign Application Priority Data

Jul. 19, 1985 [GB] United Kingdom ..... 8518234

[51] Int. Cl.[4] ..... E05C 9/00

[52] U.S. Cl. ..... 292/332

[58] Field of Search ..... 292/335, 336, 332, 38, 292/333, 334

[56] References Cited

U.S. PATENT DOCUMENTS 2,660,752 12/1953 Carcereny ..... 292/335 X
2,879,725 3/1959 Zuver ..... 292/338 X
2,996,322 8/1961 McClellan ..... 292/335 X
4,534,192 8/1985 Harshbarger et al. ..... 292/335 X

FOREIGN PATENT DOCUMENTS 1397946 6/1975 United Kingdom .

*Primary Examiner*—Richard E Moore
*Attorney, Agent, or Firm*—Jerry A. Miller

[57] ABSTRACT

A data cabinet door has a plurality of latch bolts connected by cables to a central actuating plate. When the plate is depressed by a handle to release the bolts it is itself retained in the released position by a lever acting under the bias of a spring, to keep the bolts withdrawn. This lever is connected by a cable to a release plate associated with one of the latches so that when the door is slam-closed the release plate engages an abutment on the cabinet body and pulls the lever to release the plate, which latter springs up once more and permits all the latches to engage.

5 Claims, 5 Drawing Figures

LATCHING MECHANISM

BACKGROUND

The present invention relates to latching mechanisms for container closures. In particular the invention is concerned with a mechanism for latching in the closed position the door or drawer of a fire-resistant container for the protection of magnetic data media or other like temperature-sensitive articles (for convenience herein such containers will hereafter be referred to as "data cabinets"), although mechanisms according to the invention may be of more general utility in relation to the latching of container closures where similar design considerations apply.

It is evident that the door, drawer or other closure of a data cabinet must fit tightly to the body of the cabinet when closed in order to minimise the risk of hot gases leaking into the cabinet around the door under fire conditions. Furthermore it must be recognised that when exposed to a fire there is a considerable risk that thermal distortion of the cabinet—or impacts due to falling debris or the collapse of the floor upon which the cabinet is standing—may tend to open up gaps around the closure, particularly in the larger sizes of cabinet. For this reason it is desirable to provide a plurality of latching points for the closure. It is also an aim of the invention to provide a mechanism which, for user-convenience, permits slam-closing of the closure.

The invention accordingly resides in a latching mechanism for the closure of a container comprising a plurality of spaced-apart latching elements biased to extend into latching positions in which they are adapted to retain the closure in its closed position; means for withdrawing the latching elements from their latching positions in response to operation of a handle or other like user-operable member; retaining means for automatically retaining the latching elements in their withdrawn positions consequent upon the aforesaid withdrawal; and release means for automatically releasing said retaining means, thereby to allow the latching elements to move to their latching positions, consequent upon movement of the closure to its closed position.

The invention will now be more particularly described, by way of example, with reference to the accompanying drawings, in which:

DESCRIPTION OF THE INVENTION

Figure 1:
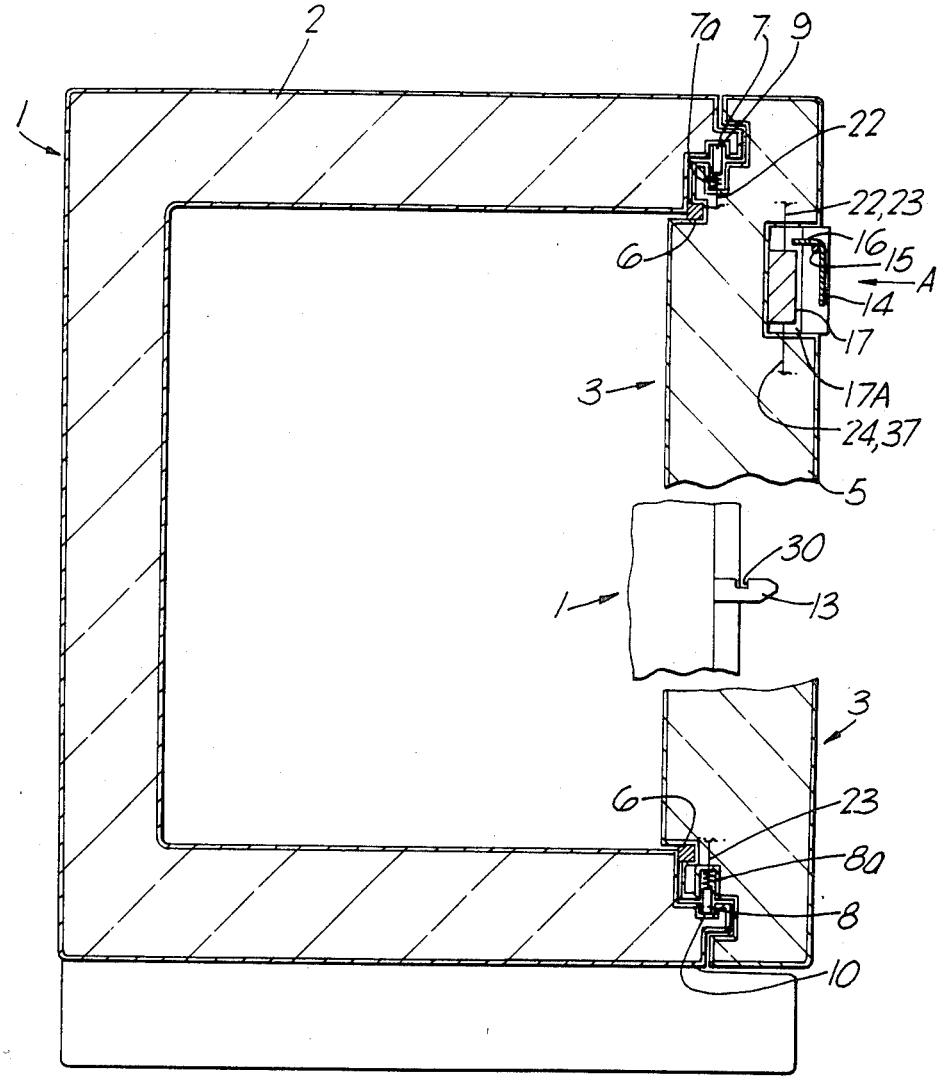
FIG. 1 is a schematic vertical section through a data cabinet equipped with a latching mechanism according to the invention, with a portion of the cabinet shown in side elevation.
Figure 2:
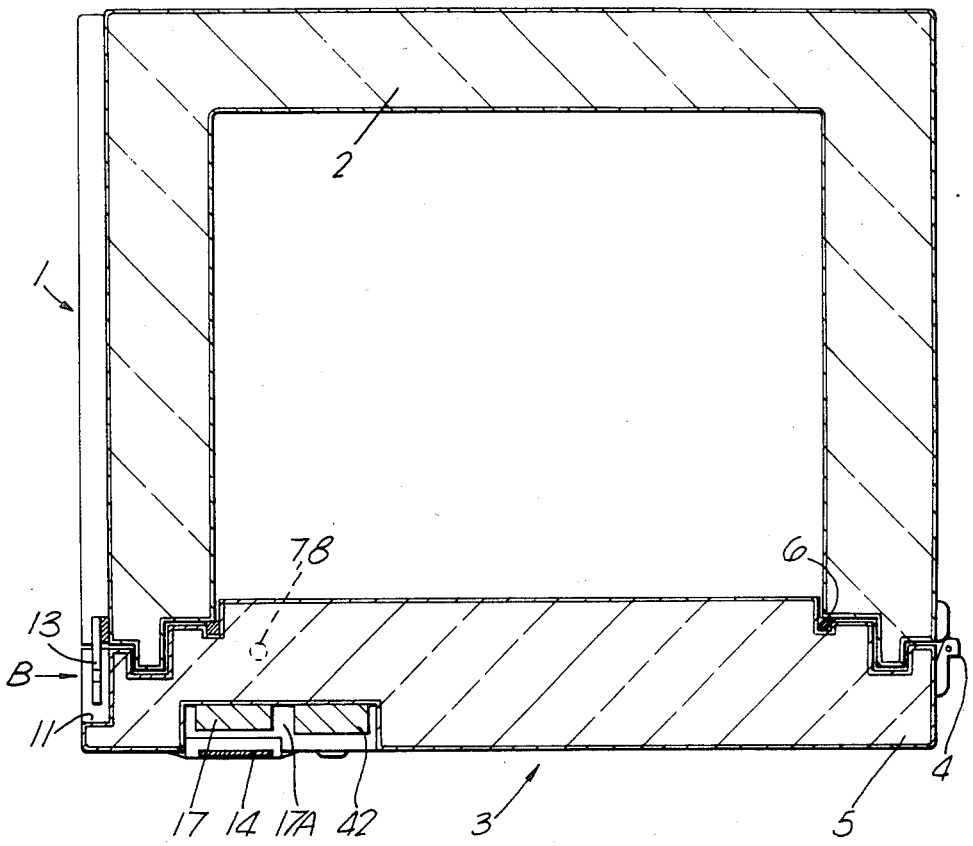
FIG. 2 is a schematic horizontal section through the cabinet of FIG. 1.

Referring to FIGS. 1 and 2, the illustrated data cabinet has a body 1 comprising inner and outer steel skins between which is a filling 2 consisting of selected heat-insulating and heat-absorbing materials arranged to achieve the desired degree of temperature stability within the cabinet under fire conditions. The door 3 of the cabinet is hinged to the body at 4 and likewise comprises steel skins with a filling 5 of selected materials similar to the body filling 2. As is usual, the door and body have stepped profiles where they meet and the door is equipped in this region with a continuous seal 6 to minimise the in-leak of hot gases around the door under fire conditions.

When closed, the door is clenched tightly against the body to compress the seal 6, and is retained against opening by latches provided at three separate positions. At the top and bottom edges of the door bolts 7 and 8 are biased by springs 7*a* and 8*a* to extend into detentions 9 and 10 provided in the body. At a more central position on the opening side edge of the door there is a compartment 11 (FIG. 2) which houses a sliding latch plate 12 (to be more fully described below with reference to FIG. 4), this plate latching into a fixed bar 13 which extends forwardly from the side edge of the cabinet body. It is this central latch which in normal usage provides the clenching action for the door, i.e. the force holding the seal 6 in compression; the top and bottom bolts 7 and 8 in this condition have a slight clearance in their detentions, the purpose of the latter bolts being essentially to resist distortion movement of the the top and bottom of the door away from the body under fire conditions. The three latching elements 7, 8 and 12 are arranged to be released simultaneously to permit the door to open, by the mechanism now to be described.

A cranked operating handle 14 is pivoted on a horizontal axis 15 in a recess at the front face of the door. By pulling this handle forwards it is caused to pivot so as to depress its rearwardly-directed operating arm 16 (FIG. 1), the latter cooperating with a mechanism indicated generally at 17 in FIGS. 1 and 2 located in a compartment 17A behind the handle. This mechanism is more fully illustrated in FIG. 3 and includes a vertically-slidable plate 18 which is depressed when the arm 16 of the handle 14 pushes down on a roller 19 carried at the top end of the plate. Anchored to the top of this plate at 20 and 21 are two cables 22 and 23 which run through the door to the top and bottom bolts 7 and 8 respectively, so that as the plate 18 is depressed the bolts 7 and 8 are withdrawn from their detentions 9 and 10 against their spring biases by the plate 18 pulling the respective cables 22 and 23. A further cable 24 is anchored to the bottom of the plate 18 at 25 and runs over a pulley 26 mounted on a fixed spindle 27. From the pulley 26 this cable runs down through the door to the latch plate 12 shown in FIG. 4*a*. The latter plate is biased by springs 28 so that its nose portion 29 engages in a recess 30 in the fixed bar 13 carried by the cabinet body. It will be appreciated, however, that as the anchorage 25 is lowered with the plate 18 the cable 24 is pulled around the pulley 26 to raise up the latch plate 12 and release it from the bar 13.

Depressing the plate 18 by pulling the handle 14, therefore, serves to release each of the latching elements 7, 8 and 12 via the respective cables 22, 23 and 24 and opening of the door will automatically follow under the action of the compressive load in the seal 6 and the pulling force on the handle. As the door opens, however, a further function occurs as explained below.

Figure 3:
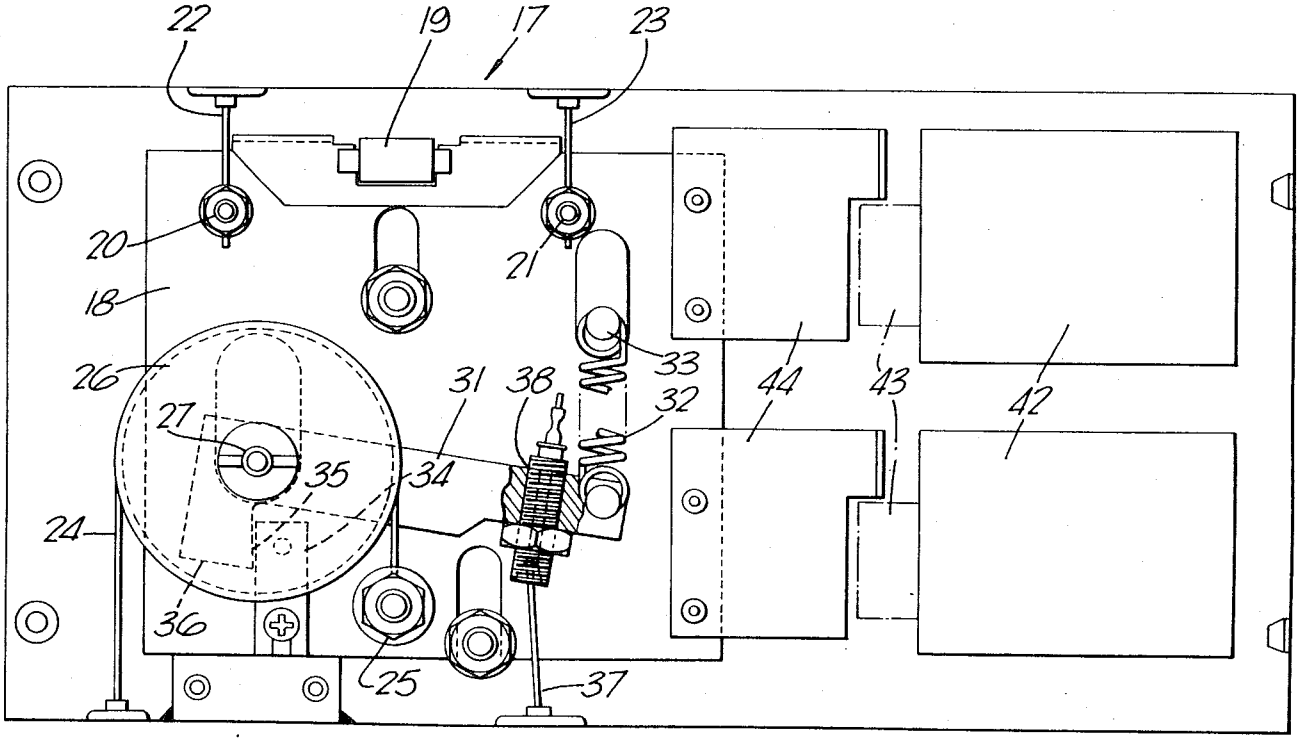
FIG. 3 is a view in the direction of the arrow "A" in FIG. 1 of a locking/triggering unit incorporated in the door of the cabinet, with the operating handle and cover plates removed.
Figure 4B:
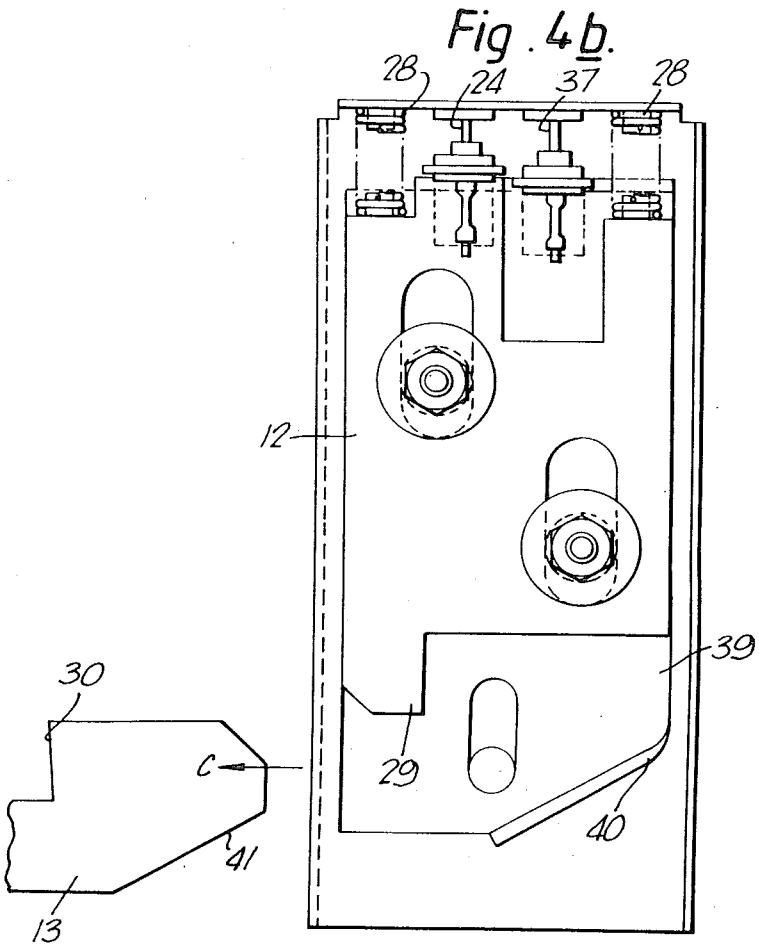
FIGS. 4*a* and 4*b* respective views in the direction of the arrow "B" in FIG. 2 of the mechanism at the central latching point for the cabinet door in its latched and released conditions.
Figure 4A:
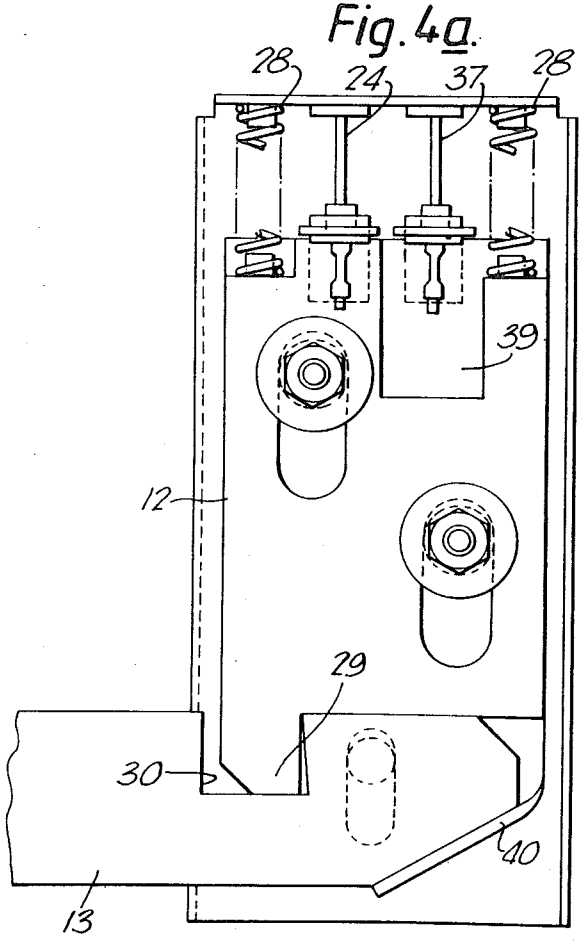

With reference to FIG. 3, an L-shaped retaining member 31 is independently pivoted on the spindle 27 behind the pulley 26. This retainer is biased in the counter-clockwise sense (as viewed in FIG. 3) by a spring 32 attached to a fixed post 33 but, while the plate 18 is in its upper (latching) position the retainer is prevented from pivoting by an abutment block 34 carried by the plate 18 and engaging the face 35 of the short arm of the retainer. When, however, the plate 18 moves down under the action of the handle 14 the retainer is released by the block 34 to move counter-clockwise into a position in which its surface 36 now overlies the block 34 to prevent return, upward movement of the plate 18. A cable 37 is also anchored at 38 to the end of the long arm of the retainer and runs down to a second sliding plate 39 behind the latching plate 12 at the central latching point (FIG. 4). In the latched condition of the door the plate 39 is held down by a flange 40 at its lower end engaging under the end of the bar 13, but as the door opens this plate is released by the bar and rises up to the FIG. 4*b* position under the action of the cable 37 as the retainer 31 is permitted to pivot counter-clockwise as described above. In the position assumed by the retainer 31 after door opening—i.e. holding down the plate 18—it will be appreciated that all three latching elements 7, 8 and 12 are held by their respective cables 22, 23 and 24 to lie in their retracted positions and thus pose no impediment to the subsequent slam-closing of the door.

As the door is slammed shut from the above-described condition, its side edge approaches the fixed bar 13 in the sense of arrow "C" in FIG. 4*b* and the flange 40 on the sliding plate 39 engages the inclined surface 41 of the bar 13 during the last part of the closing movement, so as to cam that plate downwards and, through the cable 37, sharply pull off the retainer 31 from the abutment block 34. The plate 18 is thus now freed to spring up and allow the mechanism 17 to return to the condition shown in FIG. 3, as the now-released latching elements 7, 8 and 12 shoot simultaneously under their spring biases into their detentions 9, 10 and 30 to retain the door in its closed condition. Operation of the handle 14 to close and latch the door is not therefore required.

In order that the door becomes properly clenched when slam-closed it is of course essential for the central latching plate nose 29 to engage in the recess 30 of bar 13. It is therefore important that the release of the retainer 31—and the consequent release of the latch plate 12—is in proper synchronism with the passage of the nose 29 over the recess 30. A situation which could occur if the timing is not correct is that the latch plate 12 is held up over the bar 13 while the top and bottom bolts 7 and 8 (which have a larger clearance in their detentions) are shot; the door would therefore appear to be properly closed but its clenching would not in fact be complete. In order that this timing can be properly set the anchorage 38 for the cable 37 to the retainer 31 accordingly includes a screw adjuster as seen in FIG. 3.

For locking the door when closed, any suitable key- or other code-operated mechanism can be provided for disabling the operation of the mechanism 17. In FIG. 3 this is exemplified by a pair of locks 42 whose bolts 43 when thrown block the downward movement of respective plates 44 attached to the plate 18.

What is claimed is:

1. A latching mechanism for the closure of a container comprising a plurality of spaced-apart latching elements biased to extend into latching positions in which they are adapted to retain the closure in its closed position; means for withdrawing the latching elements from their latching positions in response to operation of a handle or other like user-operable member; retaining means for automatically retaining the latching elements in their withdrawn positions consequent upon the aforesaid withdrawal; and release means for automatically releasing said retaining means, thereby to allow the latching elements to move to their latching positions, consequent upon movement of the closure to its closed position; said latching elements all being connected to a common actuating member so as to move therewith; said actuating member normally being biased to a first position corresponding to the latching positions of the latching elements but being movable by operation of said user-operable member to a second position corresponding to the withdrawn positions of the latching elements; said retaining means being biased towards a retaining position and having a portion which is engageable with an abutment on said actuating member to keep the retaining means in a released position away from its retaining position while the actuating member is in its first position but which is released by said abutment to permit the retaining means to move to its retaining position when the actuating member moves to its second position; the retaining means being connected to said release means so as to be movable thereby from its retaining position to its released position.

2. A mechanism according to claim 1 wherein said release means comprise a release member located upon the closure adjacent to a single one of said latching elements and wherein there is a fixed abutment member upon the container with which the said one of the latching elements engages when in its latching position; which abutment member also acts upon said release member when the closure moves to its closed position so as to move said retaining means from its retaining position to its released position.

3. A mechanism according to claim 1 wherein said actuating member and retaining means are located adjacent to said user-operable member but remote from said latching elements and release means; the actuating member being connected to the latching elements by respective cables and the retaining means being connected to the release means by a cable.

4. A mechanism according to claim 1 comprising means for locking the closure which are effective to throw a bolt to block movement of said actuating member from its first to its second position.

5. A fire-resistant container for the protection of temperature-sensitive, articles comprising a heat-resistive body defining an access opening for stored articles and a heat-resistive closure for said access opening; a plurality of spaced-apart latching elements upon said closure and a plurality of spaced-apart detentions upon said body for cooperation with respective said latching elements; the latching elements being biased toward latching positions in which they are adapted to retain the closure in its closed position by engagement in respective said detentions; a user-operable handle upon the closure and means within the closure for withdrawing the latching elements in unison from their latching positions in response to operation of said handle; retaining means within the closure and means biasing the retaining means to a position in which it retains the latching elements in their withdrawn positions consequent upon the aforesaid withdrawal; a release member located adjacent to one of said latching elements; and an abutment located adjacent to the said detention for said one latching element, arranged to actuate the release member when the closure is moved to its closed position; the release member being operatively connected with said retaining means such that actuation of the release member releases all of said latching elements to move in unison into their latching positions under their aforesaid bias; the said one latching element being provided at an intermediate location on said closure and other said latching elements being provided on said closure at locations on either side of said one element; and the said one latching element cooperating with its said detention to clench the closure to the body of the container in the closed position while said other latching elements have clearance with respect to their respective detentions in said position.

* * * * *